US009243790B2

(12) United States Patent
Speer et al.

(10) Patent No.: US 9,243,790 B2
(45) Date of Patent: Jan. 26, 2016

(54) MODULAR LIGHTING TECHNIQUES

(71) Applicants: Richard S. Speer, Concord, MA (US); David W. Hamby, Andover, MA (US); Thomas D. Dreeben, Swampscott, MA (US); Adam M. Scotch, Amesbury, MA (US); Kenneth G. Grossman, Beverly, MA (US)

(72) Inventors: Richard S. Speer, Concord, MA (US); David W. Hamby, Andover, MA (US); Thomas D. Dreeben, Swampscott, MA (US); Adam M. Scotch, Amesbury, MA (US); Kenneth G. Grossman, Beverly, MA (US)

(73) Assignee: OSRAM SYLVANIA INC., Wilmington, MA (US)

( * ) Notice: Subject to any disclaimer, the term of this patent is extended or adjusted under 35 U.S.C. 154(b) by 481 days.

(21) Appl. No.: 13/667,476

(22) Filed: Nov. 2, 2012

(65) Prior Publication Data

US 2014/0126208 A1 May 8, 2014

(51) Int. Cl.

| | |
|---|---|
| ***F21V 29/00*** | (2015.01) |
| ***F21V 23/06*** | (2006.01) |
| ***F21S 2/00*** | (2006.01) |
| *F21Y 101/02* | (2006.01) |

(52) U.S. Cl.
CPC ..... *F21V 23/06* (2013.01); *F21S 2/005* (2013.01); *F21Y 2101/02* (2013.01)

(58) Field of Classification Search
CPC ..... F21S 2/005; F21V 23/06; F21Y 2101/02
See application file for complete search history.

(56) References Cited

U.S. PATENT DOCUMENTS

2002/0167807 A1* 11/2002 Wu ..... 362/252
2006/0018098 A1* 1/2006 Hill et al. ..... 361/708

* cited by examiner

*Primary Examiner* — Thomas M Sember
(74) *Attorney, Agent, or Firm* — Andrew Martin

(57) ABSTRACT

Techniques and architecture are disclosed for providing a modular lighting system/luminaire having an integrated heat sink assembly. In some cases, the system/luminaire may comprise a plurality of individual modular light sources which have been operatively coupled with one another. In some instances, a modular light source may include one or more light engines (e.g., light emitting diodes or LEDs) which have been operatively coupled with an individual heat sink module. When assembled, the plurality of heat sink modules may define, in the aggregate, a plurality of heat conduits which dissipate thermal energy from the light engines by convective heat transfer. Also, in some cases, the heat sink modules may be electrically isolated from one another, allowing for the heat sink assembly itself, in part or in whole, to function as part of the desired circuit.

11 Claims, 9 Drawing Sheets

MODULAR LIGHTING TECHNIQUES

FIELD OF THE DISCLOSURE

The invention relates to lighting technology, and more particularly to modular luminaires.

BACKGROUND

Thermal management of luminaires involves a number of non-trivial challenges, and light emitting diode (LED)-based luminaires have faced particular complications at managing thermal energy output.

Figure 1:
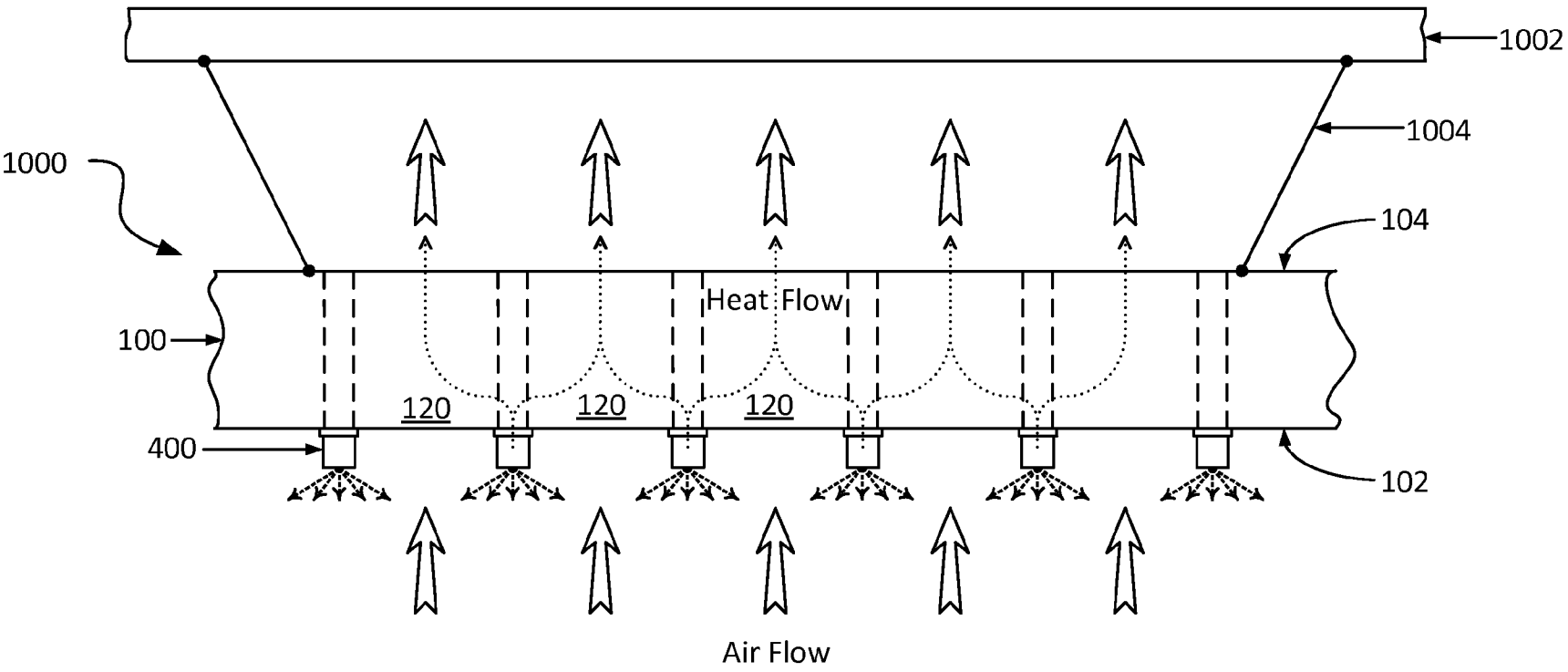
FIG. 1 is a partial side view of a modular lighting system/luminaire configured in accordance with an embodiment of the present invention.

These and other features of the present embodiments will be understood better by reading the following detailed description, taken together with the figures herein described. In the drawings, each identical or nearly identical component that is illustrated in various figures is represented by a like numeral. For purposes of clarity, not every component may be labeled in every drawing. As will be appreciated, the figures are not necessarily drawn to scale or intended to limit the claimed invention to the specific configurations shown. For instance, while some figures generally indicate straight lines, right angles, and smooth surfaces, an actual implementation of a given embodiment may have less than perfect straight lines, right angles, etc., given real world limitations. In short, the figures are provided merely to show example structures.

DETAILED DESCRIPTION

Techniques and architecture are disclosed for providing a modular lighting system/luminaire having an integrated heat sink assembly. In some cases, the system/luminaire may comprise a plurality of individual modular light sources which have been operatively coupled with one another. In some instances, a modular light source may include one or more light engines (e.g., light emitting diodes or LEDs) which have been operatively coupled with an individual heat sink module. When assembled, the plurality of heat sink modules may define, in the aggregate, a plurality of heat conduits which dissipate thermal energy from the light engines by convective heat transfer. Also, in some cases, the heat sink modules may be electrically isolated from one another, allowing for the heat sink assembly itself, in part or in whole, to function as part of the desired circuit. Numerous configurations and variations will be apparent in light of this disclosure.

General Overview

As previously noted, there are a number of non-trivial issues that can complicate management of the thermal energy output of light emitting diode (LED)-based luminaires. For instance, one non-trivial issue pertains to the fact that the performance of a given LED generally depends on the ability to manage its junction temperature to achieve a desired steady-state operating temperature. A higher junction temperature generally correlates to lower light output, lower luminaire efficiency, and/or reduced life expectancy. When a given LED is surrounded by other LEDs, the thermal energy generated by those adjacent/neighboring LEDs significantly increases the junction temperature of that light engine, which may negatively impact the performance thereof. Thus, as the light capacity (e.g., the total quantity of LEDs per unit area) of a given lighting system/luminaire increases, so too does the importance and difficulty of controlling LED junction temperature. Existing designs/approaches are limited in their ability to sufficiently manage the thermal load to control LED junction temperature, and thus they face design constraints with regard to light engine density (e.g., the quantity of light engines per cross-sectional area of the heat sink of the lighting system/luminaire). Another non-trivial issue pertains to the fact that existing heat sink structures are generally bulky in size and weight and are configured with a fixed/static structure, thereby imposing design constraints on lighting systems/luminaires which utilize such heat sink structures.

Thus, and in accordance with an embodiment of the present invention, techniques and architecture are disclosed for providing a modular lighting system/luminaire having an integrated heat sink assembly. In some cases, and in accordance with an embodiment, the disclosed techniques can be used to provide a modular lighting system/luminaire which comprises a plurality of individual modular light sources which have been operatively coupled with one another to form, in the aggregate, the system/luminaire. In some instances, and in accordance with an embodiment, a given modular light source may comprise one or more light engines (e.g., LEDs) which have been operatively coupled with an individual heat sink module. As will be appreciated in light of this disclosure, and in accordance with an embodiment, a wide variety of heat sink module configurations can be implemented, and thus the disclosed techniques can be used to provide a lighting system/luminaire design which may be customized for any given application (e.g., for a desired light output, size/weight constraints, heat management requirements, etc.).

Also, and in accordance with an embodiment, the disclosed techniques/architecture can be used to provide a modular lighting system/luminaire having an integrated heat sink assembly which includes a plurality of heat conduits which are defined, in the aggregate, by the operatively coupled heat sink modules of the constituent modular light sources. In accordance with an embodiment, the individual heat conduits may be generally configured as hollow tubes and may have any of a wide variety of geometries (e.g., lengths, cross-sections, etc.) and may be used to dissipate thermal energy produced by the light engines, for example, by means of convective heat transfer. In particular, a given light engine may transfer thermal energy (e.g., heat) to one or more heat sink modules, which in turn transfer that thermal energy to the air contained within the heat conduit formed thereby. As the temperature of the air within a given heat conduit increases, the air passes through an exit of the heat conduit, drawing in cooler ambient air at an entrance thereof, thus producing natural convection. Thus, and in accordance with an embodiment, thermal energy is transferred from the light engines to the surrounding environment by this convective heat transfer process.

In some cases, each light engine of the modular lighting system/luminaire may be provided with a heat path to ambient air which is, in accordance with an embodiment, sufficient to eliminate or otherwise reduce the cumulative effects of the thermal output generated by adjacent/neighboring light engines, thereby improving the thermal management capabilities of the system/luminaire. For example, in some cases, the cumulative effects of the thermal output generated by adjacent/neighboring light engines may be eliminated or otherwise reduced, allowing for more precise control over the junction temperature of the constituent light engines (e.g., the light engines may be made to operate within their optimal or an otherwise desired temperature range). Consequently, as will be appreciated in light of this disclosure, the disclosed techniques/architecture can be used, for example, to: (1) reduce power consumption by the system/luminaire; (2) increase the system/luminaire longevity (e.g., normal operation may be performed for a longer period of time); and/or (3) increase the light capacity of the system/luminaire (e.g., the total quantity of light engines per unit area and/or the luminous power/flux of the light engines may be increased without causing overheating).

Furthermore, and in accordance with an embodiment, the disclosed techniques can be used to provide a modular lighting system/luminaire in which the heat sink assembly itself (or portions thereof) can be used as part of the desired electrical circuit for the light engines. For example, in some cases, each individual heat sink module can be electrically isolated from its adjacent/neighboring heat sink modules by disposing there between one or more connectors which provide sufficient physical and/or thermal coupling of the individual heat sink modules (e.g., to form the desired heat sink assembly) but which are also electrically insulating.

Upon providing the desired degree of electrical isolation, any of a number of techniques can be used to provide the electrical connections to form a desired series circuit, in accordance with an embodiment. Some example techniques include, but are not limited to: (1) providing a top wire bond between a given light engine and an adjacent/neighboring heat sink module; (2) providing a series conductive clip between adjacent/neighboring modular light sources; (3) providing a card edge connector between adjacent/neighboring modular light sources; and/or (4) any other suitable means/techniques for providing the desired electrical connection, as will be apparent in light of this disclosure. As will be further appreciated in light of this disclosure, and in accordance with an embodiment, a plurality of such series circuits, in turn, may be operatively coupled with one another in parallel to provide a modular lighting system/luminaire of any desired/customized architecture.

In accordance with an embodiment, a given series/parallel circuit provided using the disclosed techniques/architecture can be driven, for example, with a DC voltage supply (e.g., in the range of about 48 V or less). As will be appreciated, it may be desirable ensure that any driving voltage used is compatible with the various materials/components implemented in the modular lighting system/luminaire. In one specific example case, the disclosed techniques may be used to provide a modular lighting system/luminaire comprising a plurality of series circuits, each including 6 LEDs and each driven by a 24 VDC source, which have been operatively coupled with one another in parallel. Other suitable arrangements/configurations and/or driving voltages will depend on a given application and will be apparent in light of this disclosure.

Also, in accordance with an embodiment, the disclosed techniques can be used to provide a modular arrangement with electrically isolated nodes which may be used for: (1) an integrated circuit chip; and/or (2) an integrated circuit package. In some cases, and in accordance with an embodiment, the disclosed techniques may allow for incorporating chips mounted directly to heat sink modules (e.g., given that provisions for forming a desired series circuit may be made using the disclosed techniques). Also, in some instances, providing a heat sink assembly which is configured to function as part of the electrical circuit may allow for omission of a circuit board (e.g., a printed circuit board or PCB) from the system architecture.

In some cases, the disclosed techniques may be used to provide a modular lighting system/luminaire which, in accordance with an embodiment, realizes reductions in cost (e.g., of production, of repair, of replacement, etc.), for example, due to: (1) the use of heat sink modules comprising relatively inexpensive materials (e.g., extruded aluminum or other suitably conductive material); (2) the increase in system/luminaire longevity; and/or (3) a decrease in wasted energy as a consequence of enhanced or otherwise improved thermal management.

As will be appreciated in light of this disclosure, the techniques/architecture described herein can be used, in accordance with an embodiment, to provide a wide variety of modular lighting systems/luminaires which may be used in a wide variety of applications. For instance, in one specific example case, the disclosed techniques can be used to provide a lighting system/luminaire suitable for use in large area and/or high bay lighting applications (e.g., a large lighting fixture of any desired geometry and having a width/diameter of about 18" or greater, such as one that could be suspended over a work space, a warehouse floor, a kitchen island, etc.). In another specific example case, a modular light source (e.g., a light engine and an associated heat sink module) can be implemented as a single pixel of a multi-pixel array of light points to make up a lighting device/system of any desired size/geometry. In some cases, and in accordance with an embodiment, the disclosed techniques can be used to provide a modular lighting system/luminaire having a customized light engine density (e.g., for a particular lighting application, for a desired steady-state operating temperature, etc.). Numerous suitable uses of one or more embodiments of the present invention will be apparent in light of this disclosure.

Furthermore, and in accordance with an embodiment, a modular lighting system/luminaire designed using the disclosed techniques/architecture can be provided, for example, as: (1) a partially/completely assembled lighting unit; and/or (2) a kit or other collection of separate components (e.g., light engines, heat sink modules/blanks, insulating connectors, etc.) which may be operatively coupled to form a desired modular lighting system/luminaire.

Luminaire Architecture and Operation

FIG. 1 is a partial side view of a modular lighting system/luminaire 1000 configured in accordance with an embodiment of the present invention. As can be seen, system/luminaire 1000 may include a heat sink assembly 100 and one or more light engines 400 operatively coupled with the heat sink assembly 100 (e.g., via a conductive adhesive or other bond). As will be appreciated in light of this disclosure, modular lighting system/luminaire 1000 may include additional, fewer, and/or different elements or components from those here described (e.g., an optional frame/guard, optional ballast circuitry, optional controller circuitry, etc.), and the claimed invention is not intended to be limited to any particular system/luminaire configuration, but can be used with numerous configurations in numerous applications.

In accordance with an embodiment, heat sink assembly 100 may be defined, in part or in whole, by a plurality of individual, enclosed heat conduits 120 (e.g., heat conduits 124, 126, etc., discussed below) which extend, for example, from its bottom/front surface 102 to its top/back surface 104. Each heat conduit 120 can be configured with an entrance portion (e.g., at or otherwise proximate to bottom/front surface 102) and an exit portion (e.g., at or otherwise proximate to top/back surface 104). Furthermore, and in accordance with an embodiment, each light engine 400 can be operatively coupled with at least one heat conduit 120 such that thermal energy generated by the light engine 400 is transferred to such heat conduit(s) 120 to cause air to flow therethrough (e.g., from the entrance to the exit thereof) as a result of natural convection processes.

It should be noted that, while FIG. 1 depicts an example modular lighting system/luminaire 1000 including light engines 400 on only its bottom/front surface 102, the claimed invention is not so limited. For instance, in some cases, and in accordance with an embodiment, one or more light engines 400 may be provided within (e.g., operatively coupled with one or more sidewalls of) a given heat conduit 120 of the heat sink assembly 100 of system/luminaire 1000.

Also, as can be seen from FIG. 1, system/luminaire 1000 can be configured to be secured (e.g., mounted, suspended, integrated, etc.) or otherwise operatively coupled with a support surface 1002 (e.g., a ceiling, a wall, a bracket, a stand, etc.), in accordance with an embodiment. In some example instances, one or more suspension means 1004 (e.g., wires, cables, rods, braces, collars, etc.) may be operatively coupled with system/luminaire 1000 (e.g., at a top/back surface 104, at a side of heat sink assembly 100, etc.) to provide the desired suspension. In some other example instances, system/luminaire 1000 can be flush mounted with support surface 1002, provided that a sufficient amount of air is permitted to flow through heat sink assembly 100 to achieve the desired amount of convective heat transfer (discussed below).

Figure 2:
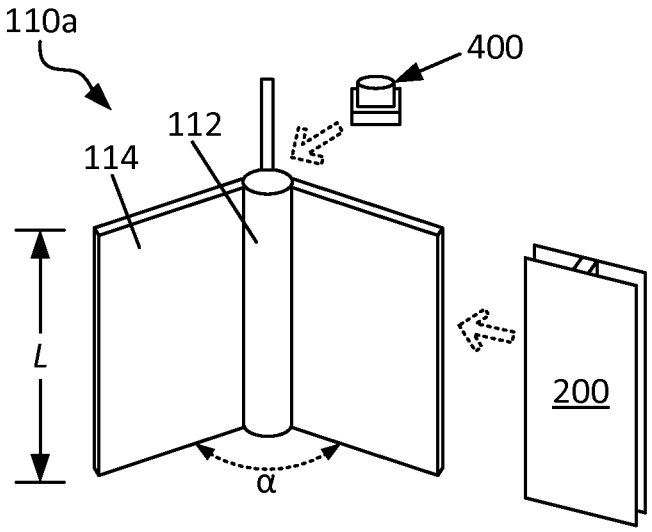
FIG. 2 is a perspective view of a three-way heat sink module configured in accordance with an embodiment of the present invention.
Figure 3:
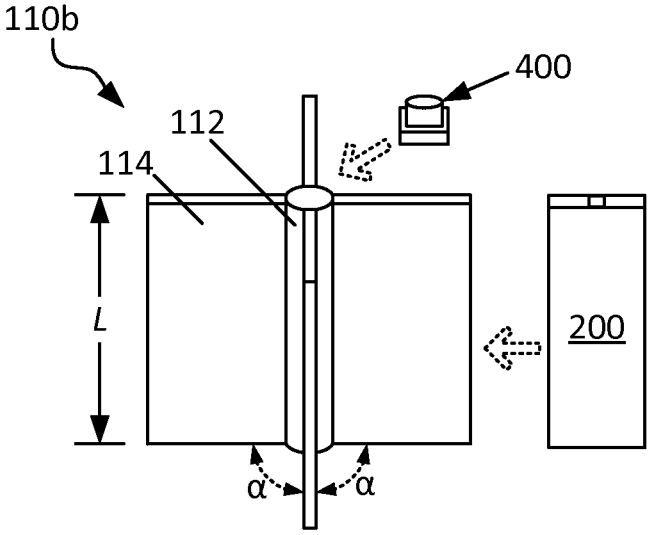
FIG. 3 is a perspective view of a four-way heat sink module configured in accordance with an embodiment of the present invention.

In accordance with an embodiment of the present invention, heat sink assembly 100 may be provided by operatively coupling a plurality of individual heat sink modules 110. As will be appreciated in light of this disclosure, the disclosed techniques can be used to provide heat sink modules 110 with any of a wide variety of configurations. For example, consider FIG. 2, which is a perspective view of a three-way heat sink module 110*a* configured in accordance with an embodiment of the present invention, and FIG. 3, which is a perspective view of a four-way heat sink module 110*b* configured in accordance with an embodiment of the present invention. As can be seen, a given heat sink module 110 (e.g., module 110*a*, module 110*b*, etc.) can be configured with a hub portion 112 and a plurality of extensions 114 arranged about hub 112 (e.g., three extensions 114 for three-way heat sink module 110*a*; four extensions 114 for four-way heat sink module 110*b*; etc.). As will be appreciated in light of this disclosure, a given heat sink module 110 may include additional, fewer, and/or different elements or components from those here described, and the claimed invention is not intended to be limited to any particular heat sink module configuration, but can be used with numerous configurations in numerous applications.

In accordance with an embodiment, hub 112 can be configured with any desired geometry (e.g., cylindrical with a circular/elliptical or other closed curve cross-section; prismatic with a square/rectangular or other polygonal cross-section; etc.) and dimensions (e.g., length, width/diameter, etc.). The geometry/dimensions of hub 112 may be chosen, at least in part, based on a number of factors, such as, but not limited to: (1) the total quantity of extensions 114 to be included; (2) the desired size and/or geometry of the resultant heat sink conduits 120 (discussed below) to be formed; and/or (3) the desired size and/or geometry of the heat sink assembly 100 to be formed. Furthermore, in some cases, the geometry/dimensions of hub 112 may depend on the desired amount of thermal conduction (e.g., from a given light engine 400 to the heat sink module 110) suitable for a given application. Other configurations and/or considerations for hub 112 will depend on a given application and will be apparent in light of this disclosure.

As can be seen, and in accordance with an embodiment, three-way heat sink module 110*a* includes a total of three extensions 114 positioned about its hub 112, and four-way heat sink module 110*b* includes a total of four extensions 114 positioned about its hub 112. However, as previously noted, the claimed invention is not limited to these example configurations. For instance, any quantity of extensions 114 (e.g., two or fewer; five or greater; etc.) may be implemented to form a heat sink module 110 in accordance with an embodiment of the present invention.

In accordance with an embodiment, the one or more extensions 114 of a given heat sink module 110 can be configured with any of a wide variety of geometries. For example, in some embodiments, one or more extensions 114 can be configured with a substantially planar geometry, such as that of a square, a rectangle, a box, a cube, a plate, a fin, a foil, a combination thereof, or another suitable substantially planar structure. However, the claimed invention is not limited to only planar extensions 114. For instance, in some embodiments, one or more extensions 114 can be configured with a curved or otherwise non-planar geometry (e.g., rounded, bent, angled, articulated, S-curved, etc.). Other suitable geometries for extensions 114 will depend on a given application and will be apparent in light of this disclosure.

Furthermore, and in accordance with an embodiment, the one or more extensions 114 of a given heat sink module 110 can be configured with any desired dimensions. For example, in some embodiments, a given extension 114 can be configured such that its length L is substantially equal to the length of hub 112 (e.g., such that the ends of extension 114 are substantially flush with the ends of hub 112). However, in some other embodiments, a given extension 114 can be configured with a length L that is greater than or less than the length of hub 112 (e.g., such that at least one end of extension 114 is not substantially flush with an end of hub 112). In some example cases, the length L of an extension 114 may be in the range of about one to five times the width/diameter of a heat conduit 120 (discussed below) with which it is associated. In one specific example embodiment, extensions 114 can be configured with a length L in the range of less than or equal to about 2" (e.g., about 0.5" or less, about 0.75" or less, about 1.0" or less, about 1.25" or less, about 1.5" or less, about 1.75" or less, etc.). Other suitable lengths L for extensions 114 will depend on a given application and will be apparent in light of this disclosure.

Also, and in accordance with an embodiment, the extensions 114 of a given heat sink module 110 can be distributed about hub 112 with any desired arrangement. For example, in some embodiments, extensions 114 may be distributed about hub 112 in equiangular fashion; that is, all angles $\alpha$ are equal. In such cases, the angle $\alpha$ between any two extensions 114 of a three-way heat sink module 110*a* may be approximately 120°. Similarly, with a four-way heat sink module 110*b*, the angle $\alpha$ between any two extensions 114 thereof may be approximately 90°. However, the claimed invention is not limited to only equiangular distributions of extensions 114. For instance, in some embodiments, extensions 114 can be arranged such that a sub-set of all angles $\alpha$ formed by extensions 114 is different from another sub-set thereof (e.g., two angles are substantially equivalent to one another but are different from two other angles; all angles are different; etc.). Other suitable distributions for extensions 114 will depend on a given application and will be apparent in light of this disclosure.

In accordance with an embodiment, a given heat sink module 110 can be made of any material which provides sufficient: (1) thermal conductivity; (2) electrical conductivity; and (3) structural strength. In some cases, it may be desirable to implement a material having a high thermal conductivity in the range of about 100-200 W/(m·K) or greater (e.g., about 100-150 W/(m·K); about 150-200 W/(m·K); about 200 W/(m·K) or greater; etc.). Thus, in some example instances, a given heat sink module 110 can be made of a metal such as, but not limited to: (1) aluminum (Al); (2) copper (Cu); (3) silver (Ag); (4) gold (Au); (5) brass; (6) steel; (7) an alloy of the aforementioned; and/or (8) any other metal that is suitably thermally and electrically conductive and is of sufficient structural stability. However, the claimed invention is not limited to implementation only with metals. For instance, in some other example embodiments, suitable composites and/or polymers (e.g., plastics doped with one or more conductive materials) may be used. Other suitable materials will depend on a given application and will be apparent in light of this disclosure.

As will be appreciated, and in accordance with an embodiment, a variety of processes/techniques can be used to form or otherwise provide a given heat sink module 110, including: (1) an extrusion process; (2) a machining process (e.g., milling); and/or (3) any other suitable formation techniques which will be apparent in light of this disclosure.

It may be desirable in some cases to provide a given heat sink module 110 with one or more highly reflective surfaces, for example, to increase the optical performance of the modular lighting system/luminaire 1000. To that end, and in accordance with an embodiment, a variety of techniques can be used, such as: (1) suitably polishing a given heat sink module 110 (e.g., the hub 112, the extensions 114, etc.); and/or (2) coating a given heat sink module 110 (e.g., the hub 112, the extensions 114, etc.) with a suitably reflective material. Other suitable techniques for achieving a desired degree of reflectivity from a given heat sink module 110 will depend on a given application and will be apparent in light of this disclosure.

Also, it may be desirable in some cases to provide a given heat sink module 110 with an optional coating which, for example: (1) protects against scratches and other abrasions; (2) dampens sound; and/or (3) alters the aesthetics of the associated lighting system/luminaire. Other suitable optional coatings for heat sink modules 110 will depend on a given application and will be apparent in light of this disclosure.

Figure 4A:
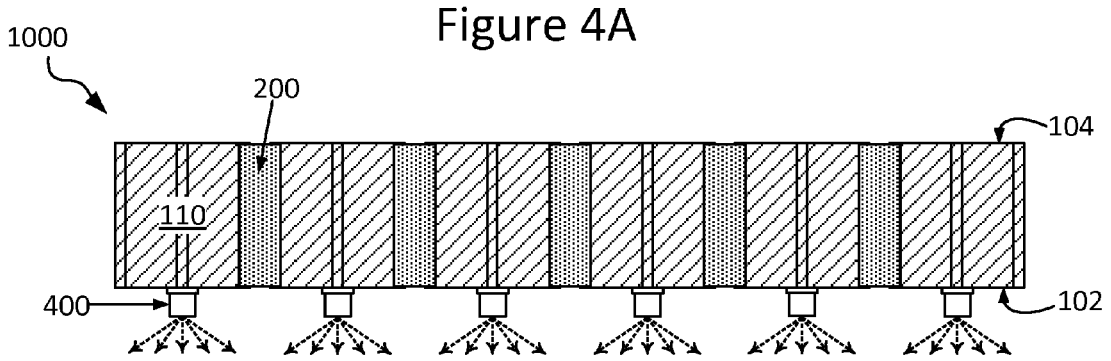
FIG. 4A is a side perspective view of a modular lighting system/luminaire configured in accordance with an embodiment of the present invention.
Figure 4B:
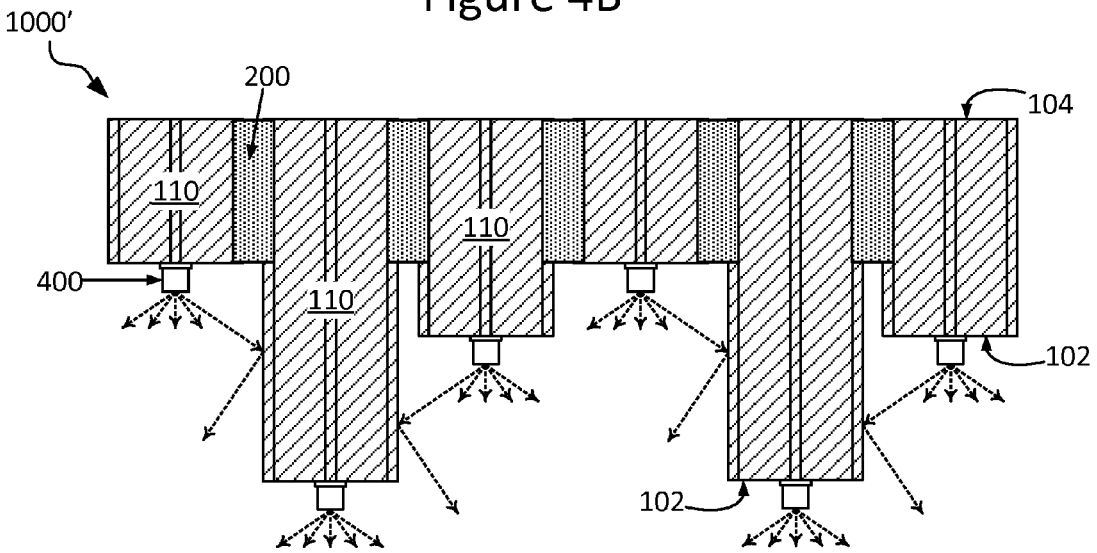
FIG. 4B is a side perspective view of a modular lighting system/luminaire configured in accordance with an embodiment of the present invention.

FIG. 4A is a side perspective view of a modular lighting system/luminaire 1000 configured in accordance with an embodiment of the present invention. As can be seen, in some cases system/luminaire 1000 can be configured with a plurality of individual heat sink modules 110 which are operatively coupled with one another by insulating connectors 200 (discussed below). As can further be seen, in some example embodiments, the heat sink modules 110 may be of substantially uniform dimensions (e.g., substantially equal lengths L, substantially equal widths, etc.). However, the claimed invention is not so limited. For example, consider FIG. 4B, which is a side perspective view of a modular lighting system/luminaire 1000' configured in accordance with an embodiment of the present invention. As can be seen, in some cases the individual heat sink modules 110 of heat sink assembly 100 can be configured with staggered or otherwise varying lengths L. In accordance with an embodiment, such a configuration may allow for reflection of the light emitted by light engines 400, which may: (1) produce a different light distribution and/or appearance which may be customized for a desired application; (2) alter the overall optical efficiency of the system/luminaire; and/or (3) change the overall aesthetics of the system/luminaire.

As previously noted, a given lighting system/luminaire 1000 may include a plurality of light engines 400. In accordance with an embodiment, one or more light engines 400 can be operatively coupled (e.g., physically, thermally, and/or electrically) with a given heat sink module 110. In some example cases, a light engine 400 can be operatively coupled with a heat sink module 110 at an end thereof (e.g., at an end of hub 112 and/or one or more extensions 114). In some other example cases, a light engine 400 can be operatively coupled within (e.g., on a sidewall of) a heat conduit 120 (discussed below).

In some cases, and in accordance with an embodiment, a given light engine 400 may comprise a semiconductor light source, such as a light emitting diode (LED). A wide variety of semiconductor light sources can be implemented, such as, but not limited to: (1) high-brightness semiconductor LEDs; (2) organic light emitting diodes (OLEDs); (3) multiple-color (e.g., bi-color, tri-color, etc.) LEDs; (4) polymer light emitting diodes (PLEDs); (5) electroluminescent (EL) strips; (6) a combination of the aforementioned; and/or (7) any other suitable semiconductor light source. When implemented as an LED, light engine 400 can be packaged, non-packaged, chip-on-board, and/or surface mounted, in accordance with an embodiment. In some instances, a portion of a light engine 400 (e.g., a bottom surface) can be configured, for example, as the negative lead of a chip. Furthermore, in some instances, and in accordance with an embodiment, the light engines 400 of a given lighting system/luminaire 1000 can be configured to be simultaneously and/or independently controlled (e.g., discussed below with reference to optional controller circuitry). In some cases, a given LED-based light engine 400 may be operatively coupled to a printed circuit board (PCB) or other suitable intermediate/substrate, which in turn can be operatively coupled with a given heat sink module 110. Other suitable configurations and/or types of light engines 400 will depend on a given application and will be apparent in light of this disclosure.

In accordance with an embodiment, a given light engine 400 may be of any desired spectral emission band (e.g., visible spectral band, infrared spectral band, ultraviolet spectral band, etc.) suitable for a given application. In some instances, a given light engine 400 may include or otherwise be implemented in conjunction with a phosphor material or the like for converting radiation emitted thereby to radiation of a different wavelength.

Figure 10A:
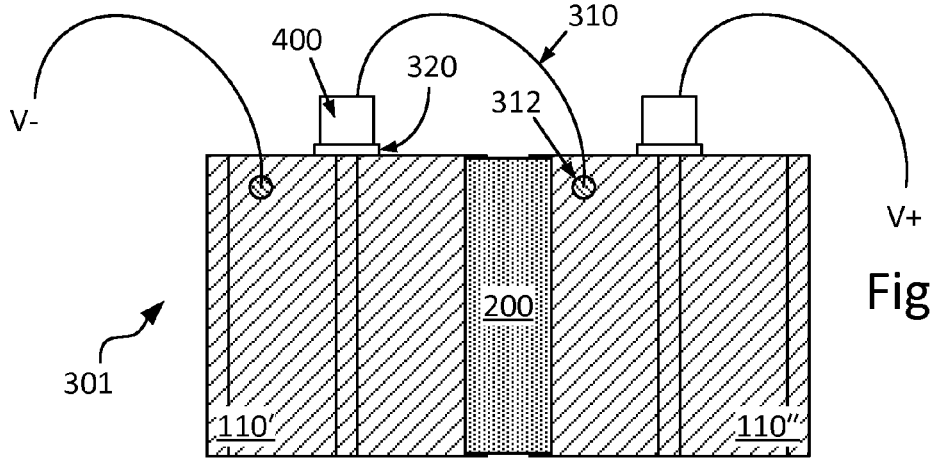
FIG. 10A is a side perspective view of a series circuit configured in accordance with an embodiment of the present invention.
Figure 10B:
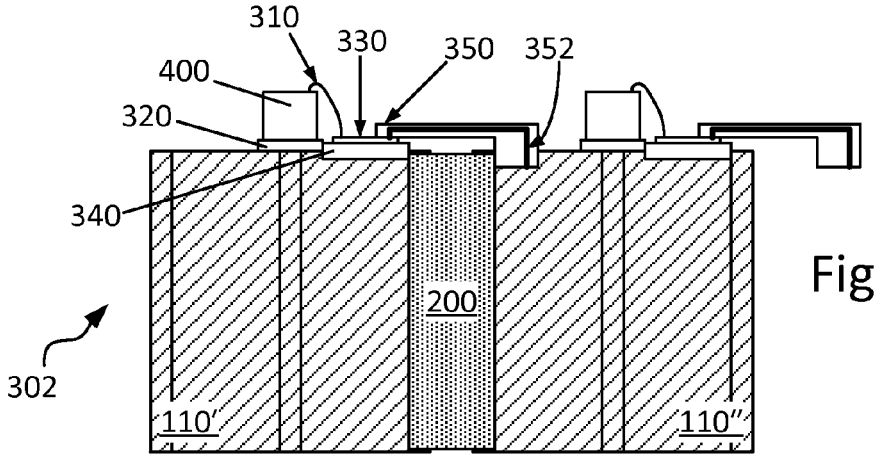
FIG. 10B is a side perspective view of a series circuit configured in accordance with an embodiment of the present invention.
Figure 10C:
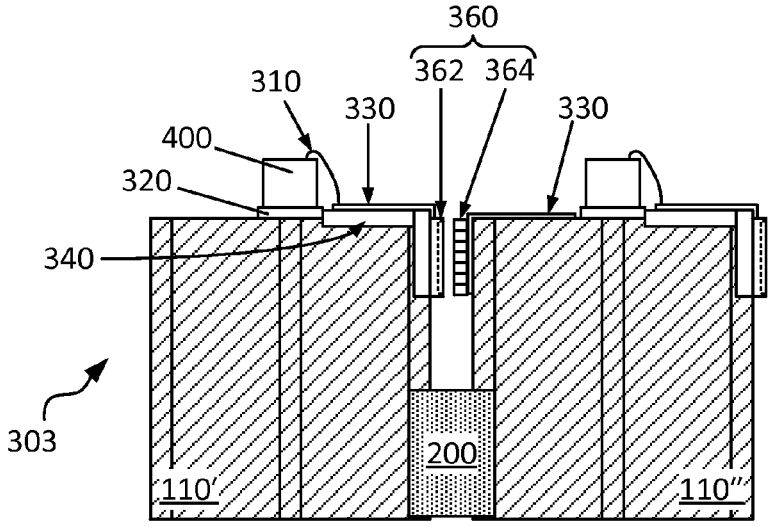
FIG. 10C is a side perspective view of a series circuit configured in accordance with an embodiment of the present invention.

As will be appreciated, it may be desirable to provide a sufficient thermal and/or electrical pathway between a given light engine 400 and its associated heat sink module 110. To that end, and in accordance with an embodiment, a quantity of a thermally and electrically conductive adhesive 320 can be disposed between the light engine 400 and its heat sink module 110 (e.g., such as is shown in FIGS. 10A-10C, discussed below). In some example instances, adhesive 320 may be a thermally and electrically conductive epoxy, and in one specific example embodiment, can be a silver (Ag)-filled epoxy (e.g., Ablestik™ ABLEBOND® 84-1LMI produced by Henkel AG & Co.).

However, as will be appreciated in light of this disclosure, the claimed invention is not so limited to epoxies or other adhesives. For instance, in some other example cases, and in accordance with an embodiment, welding, soldering, and/or one or more suitable physical fasteners can be used to provide a sufficient thermal and electrical pathway between a given light engine 400 and its associated heat sink module 110. Other suitable materials for adhesive 320 and/or techniques for operatively coupling a light engine 400 to a heat sink module 110 will depend on a given application and will be apparent in light of this disclosure.

Electrical Circuit and Conductive Coupling Mechanisms

As previously noted, and in accordance with an embodiment, the heat sink assembly 100 of a given lighting system/luminaire 1000 can be made to function, in some cases, as part of the desired electrical circuit for powering the light engines 400. For example, for a given light engine 400, the negative lead thereof may be the bottom surface of the light engine 400 and/or the underlying heat sink module 110. To provide such a configuration, it may be desirable to ensure that the modular light sources include the desired electrical connections for the desired series circuit (discussed below) and are otherwise electrically isolated from one another (e.g., by using insulating connectors 200, discussed below).

In accordance with an embodiment, an insulating connector 200 may be disposed between the extensions 114 of two or more adjacent heat sink modules 110 and configured, for instance, to physically and/or thermally couple such adjacent heat sink modules 110 while electrically isolating them from one another. In some cases, a single insulating connector 200 may be used between the extensions 114 of two adjacent heat sink modules 110, whereas in some other cases, a plurality of individual, smaller dimensioned (e.g., smaller length) insulating connectors 200 may be so implemented (e.g., such as is shown in FIG. 10C). Once in place, a given insulating connector 200 can be retained (e.g., in a removable and/or permanent fashion) between the extensions 114 of adjacent/neighboring heat sink modules 110 by any number of means, including by a snap-on or friction fit, by one or more fasteners, by an adhesive, etc.

In any such case, it may be desirable to ensure that a given insulating connector 200 comprises a material that provides electrical isolation while being sufficiently resilient to maintain structural integrity (e.g., across a broad range of temperatures and which can withstand application thereto of a potential difference of at least 24 V). Thus, and in accordance with an embodiment, insulating connector 200 may comprise a material such as, but not limited to: (1) an electrically insulating polymer such as polyvinyl chloride (PVC), nylon, acrylonitrile butadiene styrene (ABS), polyoxymethylene (e.g., DuPont™ DELRIN® acetal resin), etc.; (2) an electrically insulating composite; and/or (3) any other sufficiently electrically insulating material (e.g., thermoplastic, epoxy, etc.). Other suitable materials for use in a given insulating connector 200 will depend on a given application and will be apparent in light of this disclosure.

Figure 5A:
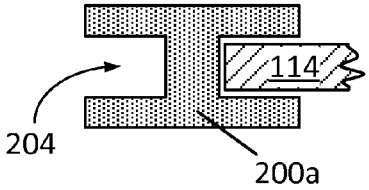
FIG. 5A is a cross-section view of a two-way insulating connector configured in accordance with an embodiment of the present invention.
Figure 5B:
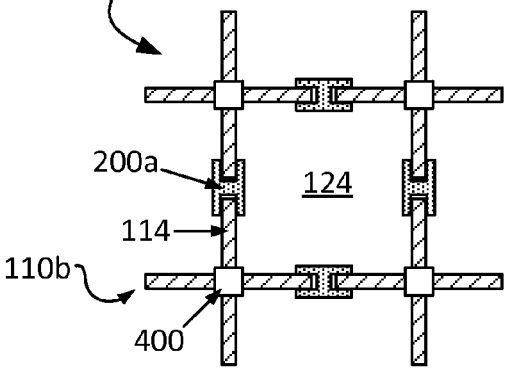
FIG. 5B is a partial schematic view of an example lighting system/luminaire configured in accordance with an embodiment of the present invention.

In accordance with an embodiment, a given insulating connector 200 can be provided with any of a wide variety of configurations. For example, consider FIG. 5A, which is a cross-section view of a two-way insulating connector 200*a* configured in accordance with an embodiment of the present invention. As can be seen, two-way insulating connector 200*a* can be configured with two regions 204 configured to receive an extension 114. In some embodiments, these receptive regions 204 may be positioned opposite one another (e.g., approximately 180° offset). However, in some other embodiments, these receptive regions 204 may be offset from one another by any given lesser angle (e.g., 45°, 60°, 90°, 120°, 135°, etc.). FIG. 5B is a partial schematic view of an example lighting system/luminaire 1000 configured in accordance with an embodiment of the present invention. As can be seen in this specific example embodiment, system/luminaire 1000 may be formed by operatively coupling a plurality of four-way heat sink modules 110*b* using a plurality of two-way insulating connectors 200*a*. As can further be seen, one or more heat sink conduits 124 having a rectangular/square (or otherwise four-sided) cross-section may be formed.

Figure 6A:
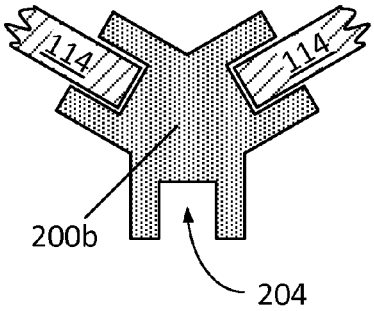
FIG. 6A is a cross-section view of a three-way insulating connector configured in accordance with an embodiment of the present invention.
Figure 6B:
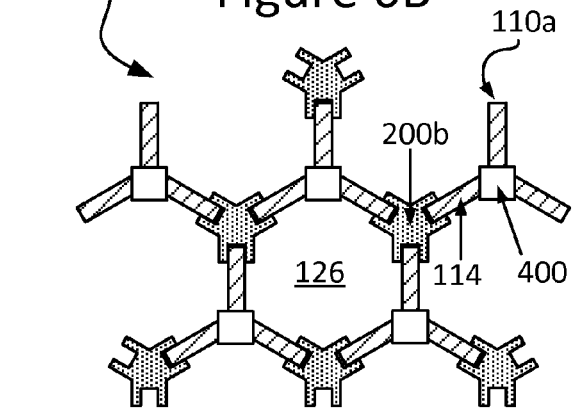
FIG. 6B is a partial schematic view of an example lighting system/luminaire configured in accordance with an embodiment of the present invention.

Furthermore, consider FIG. 6A, which is a cross-section view of a three-way insulating connector 200*b* configured in accordance with an embodiment of the present invention. As can be seen, three-way insulating connector 200*b* can be configured with three regions 204 configured to receive an extension 114. In some embodiments, these receptive regions 204 may be offset from one another in equiangular fashion (e.g., approximately 120° offset). However, in some other embodiments, these receptive regions 204 can be offset from one another by any greater and/or lesser angle. FIG. 6B is a partial schematic view of an example lighting system/luminaire 1000 configured in accordance with an embodiment of the present invention. As can be seen in this specific example embodiment, system/luminaire 1000 may be formed by operatively coupling a plurality of three-way heat sink modules 110*a* using a plurality of three-way insulating connectors 200*b*. As can further be seen, one or more heat sink conduits 126 having a hexagonal (or otherwise six-sided) cross-section may be formed.

Figure 7A:
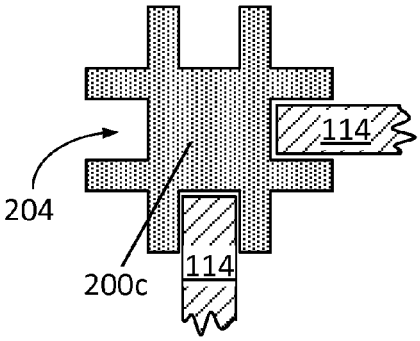
FIG. 7A is a cross-section view of a four-way insulating connector configured in accordance with an embodiment of the present invention.
Figure 7B:
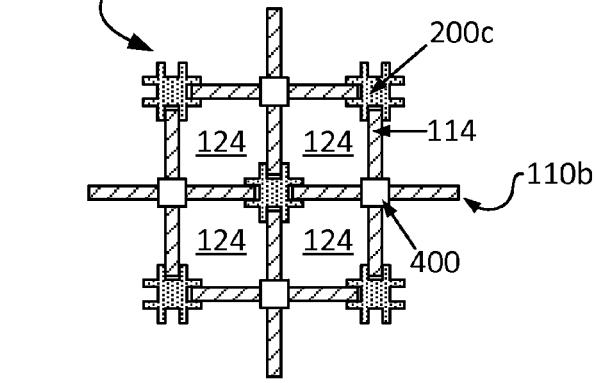
FIG. 7B is a partial schematic view of an example lighting system/luminaire configured in accordance with an embodiment of the present invention.

Still further, consider FIG. 7A, which is a cross-section view of a four-way insulating connector 200*c* configured in accordance with an embodiment of the present invention. As can be seen, four-way insulating connector 200*c* can be configured with four regions 204 configured to receive an extension 114. In some embodiments, these receptive regions 204 may be offset from one another in equiangular fashion (e.g., approximately 90° offset). However, in some other embodiments, these receptive regions 204 can be offset from one another by any greater and/or lesser angle. FIG. 7B is a partial schematic view of an example lighting system/luminaire 1000 configured in accordance with an embodiment of the present invention. As can be seen in this specific example embodiment, system/luminaire 1000 may be formed by operatively coupling a plurality of four-way heat sink modules 110*b* using a plurality of four-way insulating connectors 200*c*. As can further be seen, one or more heat sink conduits 124 having a rectangular/square (or otherwise four-sided) cross-section may be formed.

Figure 8A:
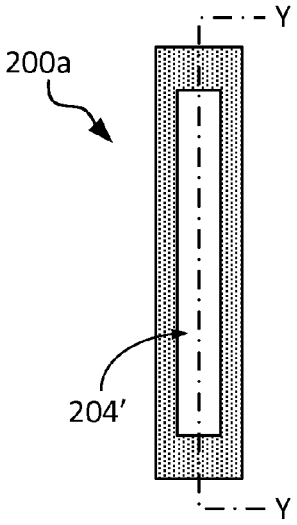
FIG. 8A is a side view of a two-way insulating connector configured with slotted receptive regions, in accordance with an embodiment of the present invention.
Figure 8B:
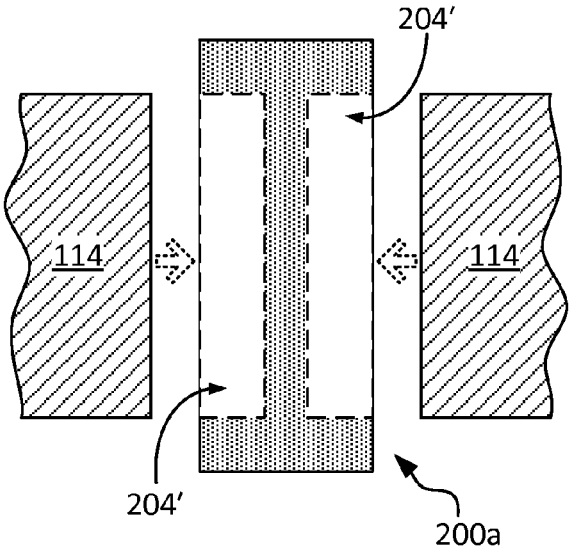
FIG. 8B is a cross-section view of the two-way insulating connector of FIG. 8A taken along dashed line Y-Y therein.

In some cases, and in accordance with an embodiment, a given insulating connector 200 (e.g., 200*a*, 200*b*, 200*c*, etc.) can be provided with receptive regions having a slotted configuration. For example, consider FIG. 8A, which is a side view of a two-way insulating connector 200*a* configured with slotted receptive regions 204', in accordance with an embodiment of the present invention, and FIG. 8B, which is a cross-section view of the two-way insulating connector 200*a* of FIG. 8A taken along dashed line Y-Y therein. As can be seen, two-way insulating connector 200*a* has been configured such that extensions 114 may be slid into the slotted receptive regions 204' within a portion of the body of connector 200*a*. As will be appreciated in light of this disclosure, and in accordance with an embodiment of the present invention, any of insulating connectors 200*a*, 200*b*, 200*c*, etc., may be implemented with one or more slotted receptive regions 204'.

Figure 9A:
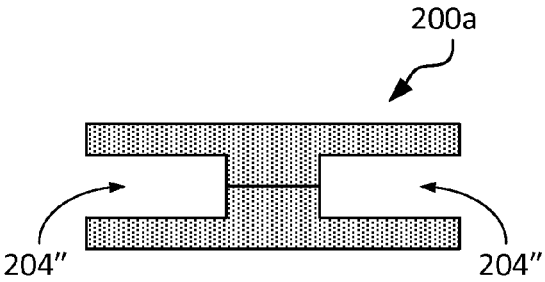
FIG. 9A is a cross-section view of a two-way insulating connector configured with assembled receptive regions, in accordance with an embodiment of the present invention.
Figure 9B:
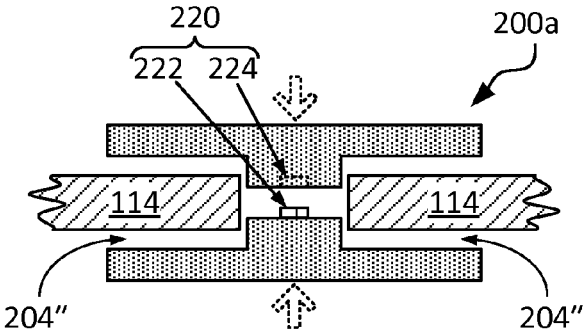
FIG. 9B is an exploded cross-section view of the two-way insulating connector of FIG. 9A.

In some cases, and in accordance with an embodiment, a given insulating connector 200 (e.g., 200*a*, 200*b*, 200*c*, etc.) can be provided with receptive regions defined by or otherwise formed upon assembling such connector. For example, consider FIG. 9A, which is a cross-section view of a two-way insulating connector 200*a* configured with assembled receptive regions 204", in accordance with an embodiment of the present invention, and FIG. 9B, which is an exploded cross-section view of the two-way insulating connector 200*a* of FIG. 9A. As can be seen, two-way insulating connector 200*a* has been configured such that extensions 114 may be received by receptive regions 204" which are defined upon assembly of connector 200*a*. In accordance with an embodiment, assembly of connector 200*a* may be facilitated by inclusion of an engagement feature 220 (e.g., a snap-fit, adhesive, tab-and-retainer, etc.) which operatively couples two or more portions of insulating connector 200*a*. In the example embodiment depicted by FIGS. 9A and 9B, engagement features 220 includes a male portion 222 and a corresponding female portion 224 which are configured to be mated with one another (e.g., temporarily and/or permanently). As will be appreciated in light of this disclosure, and in accordance with an embodiment of the present invention, any of insulating connectors 200*a*, 200*b*, 200*c*, etc., may be implemented with one or more receptive regions 204".

In some cases, a given insulating connector 200 (e.g., 200*a*, 200*b*, 200*c*, etc.) optionally may be provided with a reflective coating, in much the same fashion as discussed above with reference to heat sink modules 110. As will be appreciated, it may be desirable to ensure that such a coating for a given insulating connector 200 is not electrically conductive (e.g., to avoid shorting out the desired electrical circuit).

As previously noted, provision of the electrical connections for forming a desired circuit (e.g., for providing a desired electrical pathway through system/luminaire 1000 to power its light engines 400) may be made by any of a wide variety of techniques. For example, consider FIG. 10A, which is a side perspective view of a series circuit 301 configured in accordance with an embodiment of the present invention. As can be seen, a light engine 400 may be operatively coupled with an associated heat sink module 110' by disposing there between a quantity of electrically and thermally conductive adhesive 320 (e.g., as discussed above with reference to FIGS. 4A-4B). A wire bond 310 can be provided, in accordance with an embodiment, between such light engine 400 and an adjacent/neighboring heat sink module 110". Wire bond 310 may comprise, for example, any of a wide range of low resistivity metals, such as, but not limited to: (1) gold (Au); (2) silver (Ag); (3) aluminum (Al); (4) copper (Cu); (5) an alloy of the aforementioned; and/or (6) any other sufficiently conductive metal suitable for providing a wire bond. Furthermore, wire bond 310 may be of any desired type, including a ball bond and/or a wedge bond. In some specific example embodiments, wire bond 310 may have a diameter, for instance, in the range of 25-50 μm or greater (e.g., 32 μm or greater). In some cases, and in accordance with an embodiment, a solder point 312 may be provided on the adjacent/neighboring heat sink module 110" (e.g., on an extension 114, hub 112, etc., thereof) to help ensure the desired electrical connection with the wire bond 310.

As a further example, consider FIG. 10B, which is a side perspective view of a series circuit 302 configured in accordance with an embodiment of the present invention. As can be seen, a light engine 400 may be operatively coupled with an associated heat sink module 110' by disposing there between a quantity of electrically and thermally conductive adhesive 320 (as discussed above). A wire bond 310 (discussed above) can be provided, in accordance with an embodiment, between such light engine 400 and an associated conductor pad 330. A given conductor pad 330 may function as a positive and/or negative electrode and may have any of a wide variety of configurations, including, but not limited to: (1) a printed conductive foil; (2) a conductive tape; (3) an electroplated conductive material; (4) a molded plastic piece containing a conductive metal strip; and/or (5) any other configuration suitable for providing a conductor pad.

As can further be seen, and in accordance with an embodiment, conductor pad 330 may be disposed on an underlying insulating piece 340. In some cases, insulating piece 340 may comprise an electrically insulating material (e.g., a plastic) which can withstand application thereto of a potential difference of at least 24 V. Also, in some cases, insulating piece 340 may be configured to be operatively coupled with heat sink module 110' by any number of means, including, but not limited to, by a snap-on or friction fit, by one or more fasteners, by an adhesive, etc.

Furthermore, and in accordance with an embodiment, a series conductive clip 350 may be disposed between adjacent/neighboring heat sink modules 110' and 110" such that the embedded conductor 352 therein provides the desired electrical connection between such heat sink modules 110' and 110". In some cases, series conductive clip 350 may comprise an electrically insulating material (e.g., a plastic) having therein an embedded conductor 352 comprising an electrically conductive material (e.g., a metal) which can withstand application thereto of an electrical current of at least 1 amp DC. For instance, embedded conductor 352 may comprise: (1) copper (Cu); (2) nickel (Ni)-coated Cu wire; and/or (3) any other sufficiently conductive metal suitable for providing the desired electrical connection. Also, in some cases, series conductive clip 350 may be configured to be operatively coupled with heat sink modules 110' and 110" by any number of means, including, but not limited to, by a snap-on or friction fit, by one or more fasteners, by an adhesive, etc.

As yet a further example, consider FIG. 10C, which is a side perspective view of a series circuit 303 configured in accordance with an embodiment of the present invention. In much the same fashion as discussed above with reference to FIG. 10B, a light engine 400 may be operatively coupled with an associated heat sink module 110' using conductive adhesive 320, and a wire bond 310 can be provided between the light engine 400 and an associated conductor pad 330, which may be disposed on an underlying insulating piece 340 operatively coupled with heat sink module 110'. As will be appreciated, the discussion above of wire bond 310, conductive adhesive 320, conductor pad 330, and insulating piece 340 applies equally as well here.

As can be seen here in FIG. 10C, however, and in accordance with an embodiment, a card edge connector 360 may be disposed between adjacent/neighboring heat sink modules 110' and 110" such that a first portion 362 (e.g., female portion) and a second portion 364 (e.g., male portion) may be operatively coupled (e.g., mated or otherwise electrically coupled) to provide the desired electrical connection between such heat sink modules 110' and 110". It may be desirable to ensure that card edge connector 360 is configured to withstand application thereto of an electrical current of at least 1 amp DC. In some cases, a corresponding conductor pad 330 and/or electrically conductive adhesive may be provided on the adjacent/neighboring heat sink module 110" to provide the desired electrical connection. Also, in some cases, it may be desirable to adjust the dimensions of the one or more insulating connectors 200 to ensure sufficient space for implementing a given card edge connector 360.

By virtue of providing an electrical pathway using any of the techniques discussed above with reference to example embodiments depicted in FIGS. 10A-10C and by otherwise electrically isolating the adjacent/neighboring heat sink modules 110' and 110" (e.g., by using one or more insulating connectors 200 there between), a series circuit may be formed whereby the heat sink modules function as part of the circuit for powering the light engines 400 operatively coupled thereto, in accordance with an embodiment.

As will be appreciated, and in accordance with an embodiment, it may be desirable in some instances to form a given wire bond 310, for example, after: (1) assembly of the heat sink assembly 100; and/or (2) operative coupling of the one or more light engines 400 with the heat sink assembly 100.

Thermal Management

As previously noted, and in accordance with an embodiment, the heat sink assembly 100 of a given lighting system/luminaire 1000 can be provided with a matrix-like configuration of heat conduits 120 having any of a wide variety of configurations (e.g., dimensions, cross-sectional geometries, etc.). In some cases, a heat sink assembly 100 may include only one type/configuration of heat conduits 120 (e.g., heat sink assembly 100 may have a uniform or homogeneous profile). In some other cases, a heat sink assembly 100 may include two or more types/configurations of heat conduits 120 (e.g., heat sink assembly 100 may have a non-uniform or heterogeneous profile). In some instances, a regular/periodic arrangement of heat conduits 120 may be provided, while in some other instances, an irregular arrangement thereof may be provided. As will be appreciated in light of this disclosure, the disclosed techniques/architecture can be used to provide a heat sink assembly 100 (and thus a lighting system/luminaire 1000) having any desired configuration.

In accordance with an embodiment, a given heat conduit 120 can be configured as a hollow tube having an entrance portion and an exit portion which are positioned at opposing ends thereof. A given heat conduit 120 may be made to extend between its entrance (e.g., which may be at or otherwise near a bottom/front surface 102 of heat sink assembly 100) and its exit (e.g., which may be at or otherwise near a top/back surface 104 of heat sink assembly 100). The one or more sidewalls of a given heat conduit 120 are defined by a given arrangement of adjacent/neighboring heat sink modules 110 (e.g., by virtue of how the extensions 114, hubs 112, and/or insulating connectors 200 thereof are arranged). Thus, as will be appreciated, any two adjacent/neighboring heat conduits 120 may share a common sidewall.

In accordance with an embodiment, the dimensions (e.g., length, width/diameter, etc.) of a given heat conduit 120 may be customized for a given application. In some instances, the dimensions of a given heat conduit 120 may be tailored based on a number of considerations, including: (1) the maximum power rating of the light engines 400; (2) the desired steady-state junction temperature of the light engines 400; and/or (3) the desired overall dimensions (e.g., size, shape, weight, etc.) of the modular lighting system/luminaire 1000 to be formed. In some cases, it may be desirable to ensure that a given heat conduit 120 has a diameter/width in the range of about five to ten times that of the light engine(s) 400 with which it may be operatively coupled. For instance, if a light engine 400 has a width/diameter of about 1 mm, then it may be desirable to ensure that a heat conduit 120 associated therewith has a width/diameter in the range of about 5-10 mm or greater. As will be appreciated further in light of this disclosure, the dimensions of a given heat conduit 120 can be varied as desired by making adjustments to: (1) the dimensions of one or more of the heat sink modules 110 which define, in part, the heat conduit 120; and/or (2) the dimensions of one or more of the insulating connectors 200 which define, in part, the heat conduit 120.

In accordance with an embodiment, the disclosed techniques can be used to provide heat conduits 120 having any of a wide variety of cross-sectional geometries. For example, consider FIG. 11A, which is a partial schematic view of a modular lighting system/luminaire 1000 including a heat sink assembly 100 having hexagonal heat conduits 126, in accordance with an embodiment of the present invention, and FIG. 11B, which is a partial schematic view of the portion of FIG. 11A enclosed by the dashed box therein. As can be seen, and in accordance with one specific example embodiment, heat sink assembly 100 (and thus modular lighting system/luminaire 1000) may be configured with heat conduits 126 having hexagonal cross-sections (e.g., forming a honeycomb-like structure). In some cases, and in accordance with an embodiment, this may be achieved by operatively coupling a plurality of three-way heat sink modules 110*a* using, for example: (1) a plurality of two-way insulating connectors 200*a*; and/or (2) a plurality of three-way insulating connectors 200*b*. In either such instance, six sidewalls which define the bounds of the hexagonal heat conduit 126 are provided (e.g., by virtue of extensions 114, hubs 112, and insulating connectors 200).

Figure 11A:
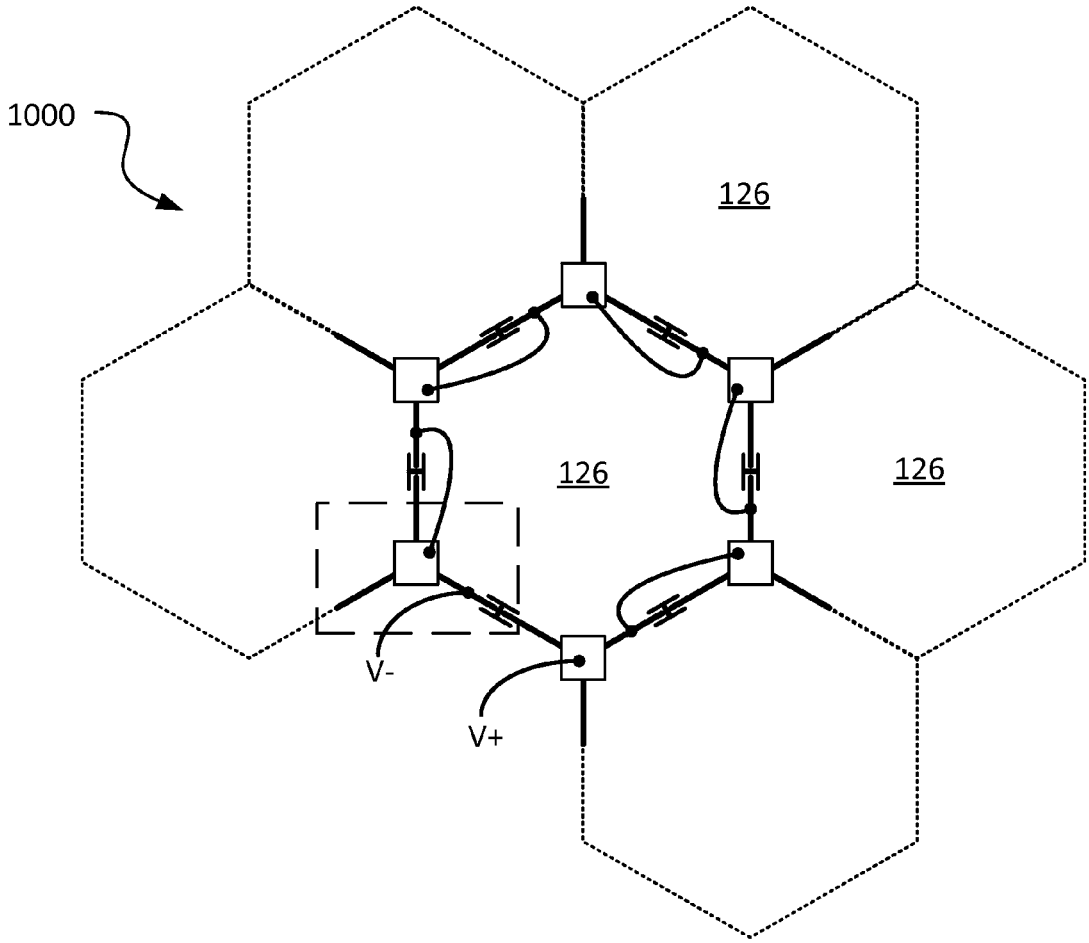
FIG. 11A is a partial schematic view of a modular lighting system/luminaire including a heat sink assembly having hexagonal heat conduits, in accordance with an embodiment of the present invention.
Figure 11B:
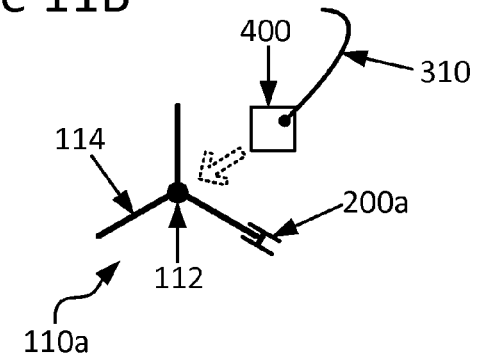
FIG. 11B is a partial schematic view of the portion of FIG. 11A enclosed by the dashed box therein.

As will be appreciated, utilizing different types of insulating connectors 200 may result in changes to the total quantity of three-way heat sink modules 110*a* which define a given hexagonal heat conduit 126. For instance, in some example embodiments, two-way insulating connectors 200*a* may be used, and thus a total of six operatively coupled three-way heat sink modules 110*a* may define a given hexagonal heat conduit 126 (e.g., such as is depicted in FIG. 11A). In some other example embodiments, however, three-way insulating connectors 200*b* may be used, and thus a total of three operatively coupled three-way heat sink modules 110*a* may define a given hexagonal heat conduit 126 (e.g., such as is depicted in FIG. 6B). Other suitable techniques for providing a heat sink assembly 100 (and thus a modular lighting system/luminaire 1000) with hexagonal (or otherwise six-sided) heat conduits 126 will depend on a given application and will be apparent in light of this disclosure.

Figure 12A:
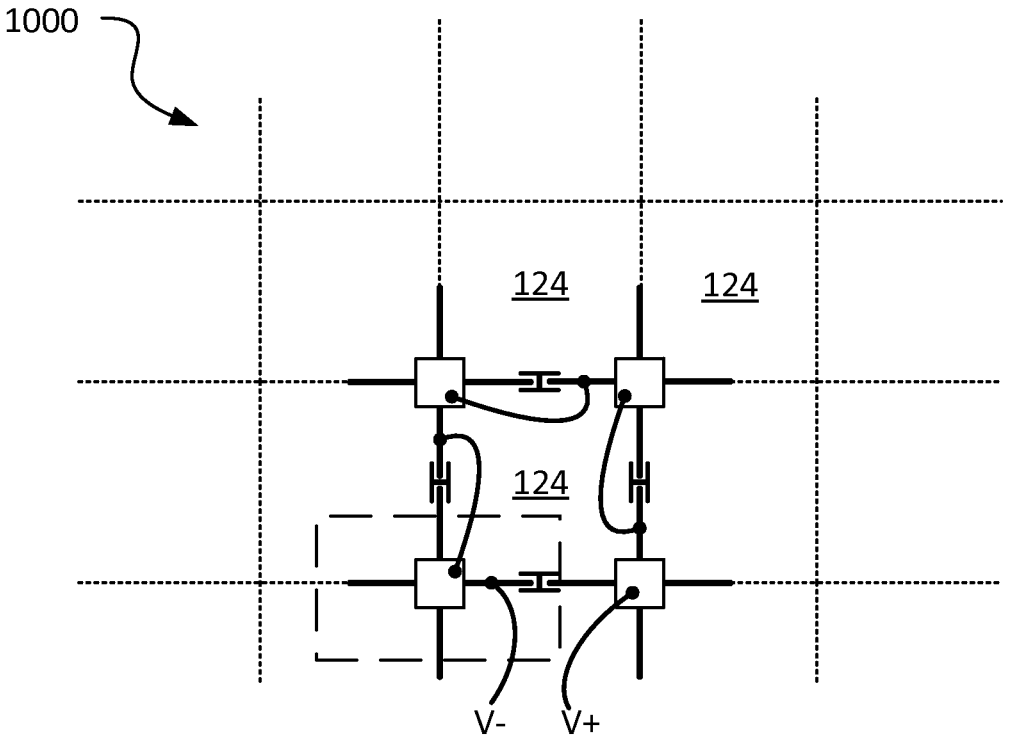
FIG. 12A is a partial schematic view of a modular lighting system/luminaire including a heat sink assembly having rectangular/square heat conduits, in accordance with an embodiment of the present invention.
Figure 12B:
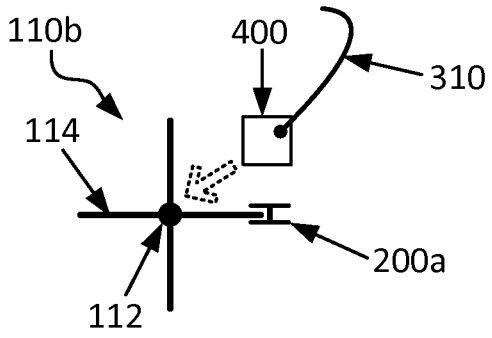
FIG. 12B is a partial schematic view of the portion of FIG. 12A enclosed by the dashed box therein.

As a further example, consider FIG. 12A, which is a partial schematic view of a modular lighting system/luminaire 1000 including a heat sink assembly 100 having rectangular/square heat conduits 124, in accordance with an embodiment of the present invention, and FIG. 12B, which is a partial schematic view of the portion of FIG. 12A enclosed by the dashed box therein. As can be seen, and in accordance with one specific example embodiment, heat sink assembly 100 (and thus modular lighting system/luminaire 1000) may be configured with heat conduits 124 having rectangular/square cross-sections (e.g., forming a lattice-like structure). In some cases, and in accordance with an embodiment, this may be achieved by operatively coupling a plurality of four-way heat sink modules 110*b* using, for example: (1) a plurality of two-way insulating connectors 200*a*; and/or (2) a plurality of four-way insulating connectors 200*c*. In either such instance, four sidewalls which define the bounds of the rectangular/square conduit 124 are provided (e.g., by virtue of extensions 114, hubs 112, and insulating connectors 200).

As will be appreciated, utilizing different types of insulating connectors 200 may result in changes to the total quantity of four-way heat sink modules 110*b* which define a given rectangular/square heat conduit 124. For instance, in some example embodiments, two-way insulating connectors 200*a* may be used, and thus a total of four operatively coupled four-way heat sink modules 110*b* may define a given rectangular/square heat conduit 124 (e.g., such as is depicted in FIG. 12A). In some other example embodiments, however, four-way insulating connectors 200*c* may be used, and thus a total of two operatively coupled four-way heat sink modules 110*b* may define a given rectangular/square heat conduit 124 (e.g., such as is depicted in FIG. 7B). Other suitable techniques for providing a heat sink assembly 100 (and thus a modular lighting system/luminaire 1000) with rectangular/square (or otherwise four-sided) heat conduits 124 will depend on a given application and will be apparent in light of this disclosure.

Figure 13:
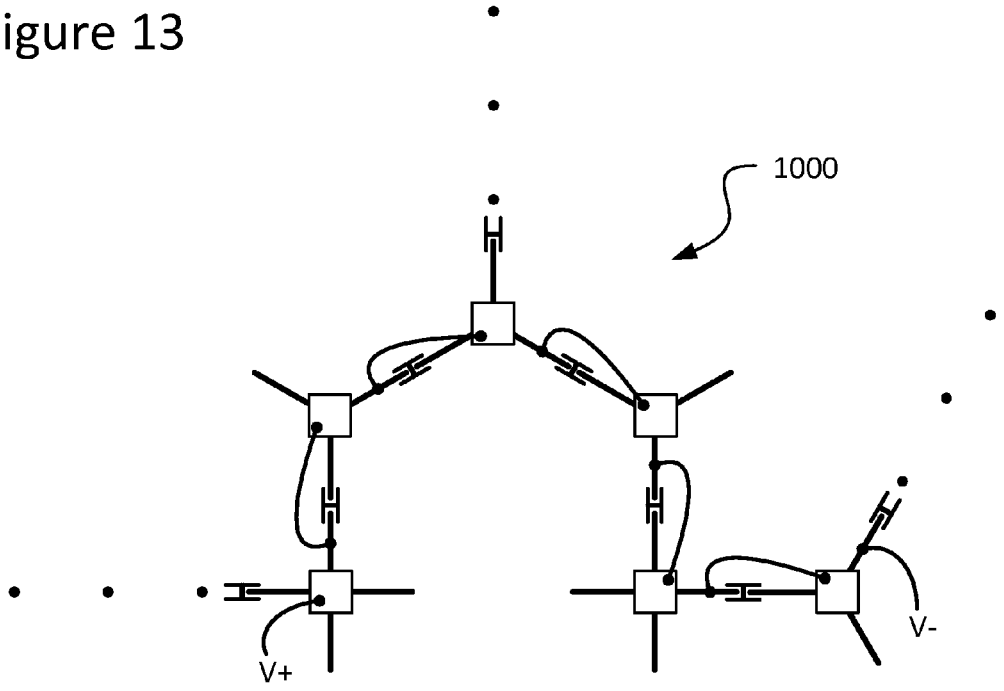
FIG. 13 is a partial schematic view of a modular lighting system/luminaire including a heat sink assembly configured in accordance with an embodiment of the present invention.

As yet a further example, consider FIG. 13, which is a partial schematic view of a modular lighting system/luminaire 1000 including a heat sink assembly 100 configured in accordance with an embodiment of the present invention. As can be seen, the disclosed techniques can be used, in accordance with an embodiment, to provide a heat sink assembly 100 (and thus a modular lighting system/luminaire 1000) with any custom configuration. In some cases, a plurality of three-way heat sink modules 110*a* and a plurality of four-way heat sink modules 110*b* (and/or other heat sink modules 110 as variously described herein) may be operatively coupled (e.g., using any one or more types of insulating connectors 200) to provide a custom structure having custom heat conduits 120. Other suitable configurations will depend on a given application and will be apparent in light of this disclosure.

It should be noted, however, that the claimed invention is not limited to heat conduits 120 having only polygonal or angled cross-sectional geometries (e.g., such as rectangular/square heat conduits 124, hexagonal heat conduits 126, etc.). For instance, in some other embodiments, a heat sink module 110 may be configured with curved/non-planar extensions 114, such that, upon operatively coupling with one or more similar heat sink modules 110, heat conduits 120 having an elliptical/circular or otherwise curved cross-sectional geometry may be provided.

As will be appreciated in light of this disclosure, the disclosed techniques can be used, in accordance with an embodiment, to provide a heat sink assembly 100 (and thus a modular lighting system/luminaire 1000) which is substantially planar (e.g., bottom/front surface 102 and top/back surface 104 lie in substantially parallel planes). However, the claimed invention is not so limited. For instance, in some other cases, a non-planar/curved (e.g., concave, convex, S-shaped, etc.) heat sink assembly 100 (and thus a modular lighting system/luminaire 1000) may be provided. For example, and in accordance with an embodiment, heat sink modules 110 may be configured to provide heat conduits 120 having pentagonal cross-sectional geometries, allowing for a curved lighting surface.

In accordance with an embodiment, the disclosed techniques can be used to provide a heat sink assembly 100 (and thus a modular lighting system/luminaire 1000) which dissipates heat via convective heat transfer as described, for example, in U.S. patent application Ser. No. 13/277,500, filed on Oct. 20, 2011, titled "LIGHTING SYSTEM WITH A HEAT SINK HAVING PLURALITY OF HEAT CONDUITS," which is herein incorporated by reference in its entirety.

For example, and in accordance with an embodiment, one or more light engines 400 may be operatively coupled with (e.g., thermally associated with or otherwise configured to transfer thermal energy/heat to) a heat sink module 110. As previously noted, a given light engine 400 may be disposed: (1) proximate the entrance of a given heat conduit 120 (e.g., on a bottom/front surface 102); and/or (2) within a given heat conduit 120 (e.g., on the one or more sidewalls thereof). As a given light engine 400 generates thermal energy (e.g., heat), a portion of that heat may be transferred to its associated heat sink module 110 and possibly to one or more adjacent/neighboring heat sink modules 110. This transfer of thermal energy heats the sidewalls of one or more heat conduits 120 (e.g., defined by a plurality of heat sink modules 110), which in turn transfer at least a portion of the thermal energy to the air within those heat conduits 120. As the temperature of the air within the heat conduits 120 increases, the heated air moves through the heat conduits 120 and exits the heat sink assembly 100, for example, at the top/back surface 104 thereof. This draws in cooler ambient air at the bottom/front surface 102 of the heat sink assembly 100, resulting in natural convection. By providing such an air flow, thermal energy generated by the light engines 400 can be transferred to the surrounding environment (e.g., the air) by convective heat transfer, thereby minimizing or otherwise reducing the accumulation of thermal energy which otherwise would negatively impact performance.

As previously discussed, the performance of a given light engine generally depends on the ability to manage its junction temperature to achieve a desired steady-state operating temperature. Often, this is limited by the ability of the lighting system/luminaire to manage the amount of heat generated by that light engine as well as adjacent/neighboring light engines. Accordingly, most lighting systems/luminaires face design constraints with regard to light engine density (e.g., the quantity of light engines per cross-sectional area of the heat sink of the lighting system/luminaire).

However, in accordance with an embodiment, the disclosed techniques can be used to provide a modular lighting system/luminaire 1000 in which each light engine 400 thereof is provided with a sufficiently direct heat path to ambient air which minimizes or otherwise reduces the cumulative effects of thermal energy generated by adjacent/neighboring light engines 400 on a given reference light engine 400. As a result, such a light engine 400 may be provided with improved junction temperature management. As previously noted, and in accordance with an embodiment, improvements in junction temperature management may provide for: (1) an overall increase in light engine density (e.g., the lighting capacity of the modular lighting system/luminaire 1000 can be increased) while maintaining a desired steady-state operating temperature; (2) an increase in luminous power (luminous flux) of the modular lighting system/luminaire 1000 (e.g., by virtue of the increase in permissible light engine density and/or the reduced junction temperature at steady state); and/or (3) an increase in the lifespan/longevity of a given light engine 400 (e.g., due to the reduced junction temperature at steady state).

Additional Features and Variations

In some cases, each heat sink module 110 of a given heat sink assembly 100 may be associated with at least one light engine 400. However, the claimed invention is not so limited. For instance, and in accordance with an embodiment, in some cases it may be desirable to provide a wider and/or more irregular distribution of light engines 400. In some such instances, and in accordance with an embodiment, heat sink blanks (e.g., a heat sink module 110 with no associated light engine 400) may be used to provide the desired structural and/or electrical connections without increasing light engine density. Other suitable considerations for the use of heat sink blanks will depend on a given application and will be apparent in light of this disclosure.

In some cases, and in accordance with an embodiment, modular lighting system/luminaire 1000 optionally may include ballast circuitry. In some such cases, the ballast circuitry can be configured, for example, to convert an AC signal (e.g., supplied by electrical wiring in mounting surface 1002) into a DC signal at a desired current and voltage (e.g., 24 VDC) to power the one or more light engines 400. Also, in some cases, and in accordance with an embodiment, modular lighting system/luminaire 1000 optionally may include controller circuitry. In some such cases, the controller circuitry can be configured to generate one or more control signals to adjust the operation of the light engines 400. Some examples of controller circuitry include, but are not limited to: (1) dimmer circuitry to control the brightness of the light engines 400; (2) circuitry to control the color of the light emitted by the light engines 400 (e.g., one or more of the light engines 400 may include two or more LEDs configured to emit light having different wavelengths, wherein the controller circuitry may adjust the relative brightness of the different LEDs in order to change the mixed color from the light engines 400); (3) an ambient light sensor to adjust for changes in ambient lighting conditions; (4) a temperature sensor to adjust for temperature changes; (5) a sensor to adjust for changes in output due to lifespan changes; etc. Other suitable ballast circuitry and/or controller circuitry configurations will depend on a given application and will be apparent in light of this disclosure.

Figure 14A:
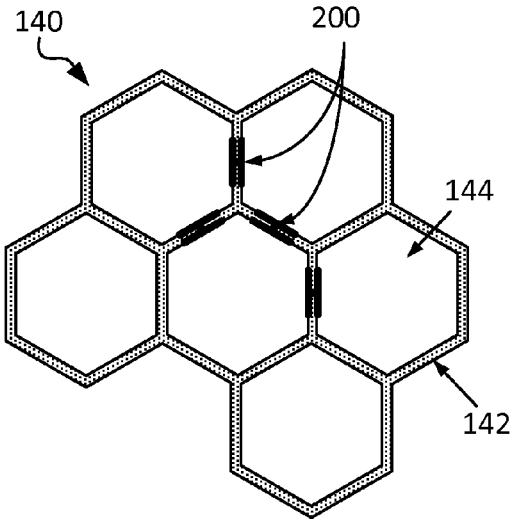
FIG. 14A is a partial front perspective view of an optional frame/guard configured in accordance with an embodiment of the present invention.
Figure 14B:
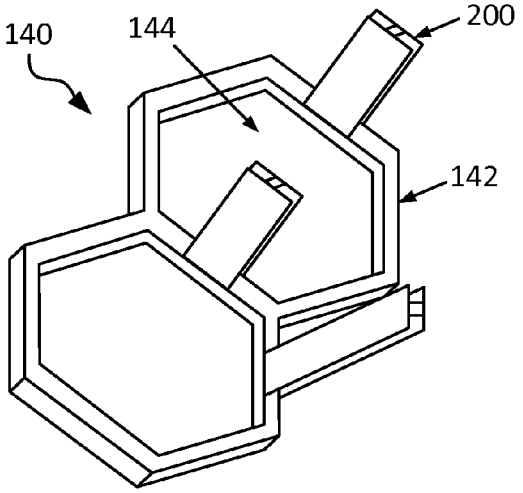
FIG. 14B is a partial side perspective view of an optional frame/guard configured in accordance with an embodiment of the present invention.

In some instances, and in accordance with an embodiment, an optional frame/guard 140 may be configured to be operatively coupled with a given heat sink assembly 100 (e.g., at the top/back surface 104 thereof). For example, consider FIGS. 14A and 14B, which are a partial front perspective view and a partial side perspective view, respectively, of an optional frame/guard 140, configured in accordance with an embodiment of the present invention. As can be seen, optional frame/guard 140 may be configured with a body 142 and a plurality of apertures 144 which substantially match the profile of the heat sink assembly 100, in accordance with an embodiment. For instance, if a heat sink assembly 100 having hexagonal heat conduits 126 is provided, then optional frame/guard 140 may be provided with a body 142 and apertures 144 to match (e.g., such as that shown in the figures). However, as will be appreciated in light of this disclosure, and in accordance with an embodiment, optional frame/guard 140 can be configured to accommodate heat conduits 120 of any cross-sectional geometries (e.g., heat sink assemblies 100 of uniform and/or non-uniform profile).

As will be appreciated, and in accordance with an embodiment, it may be desirable to ensure that apertures 144 are sufficiently dimensioned so as to maintain the desired air flow through the heat conduits 120 of the heat sink assembly 100. Also, in some cases, and in accordance with an embodiment, body 142 may include one or more grooves, tracks, or other suitable recesses which are configured to receive or otherwise operatively couple with heat sink assembly 100.

It may be desirable to provide a frame/guard 140 which, in accordance with an embodiment: (1) provides sufficient electrical isolation to maintain the desired electrical pathway through modular lighting system/luminaire 1000; (2) provides sufficient electrical isolation to protect against the risk of electric shock (e.g., upon touching the top/back surface 104 of the heat sink assembly 100); and/or (3) provides sufficient structural strength to maintain the structural integrity of heat sink assembly 100 (and thus of modular lighting system/luminaire 1000). Thus, and in accordance with an embodiment, body 142 may be made of a plastic such as, but not limited to, acrylonitrile butadiene styrene (ABS). Other suitable materials for optional frame/guard 140 will depend on a given application and will be apparent in light of this disclosure.

In some cases, and in accordance with an embodiment, optional frame/guard 140 may be configured with insulating conductors 200 (discussed above) which are integral to body 142 and which may be disposed between the heat sink modules 110 (e.g., the individual heat sink modules 110 can be slid into place in any desired arrangement). Thus, frame/guard 140 may be made to function as a template or form for configuring the heat sink assembly 100 (and thus the modular lighting system/luminaire 1000) while simultaneously providing the desired electrical isolation between heat sink modules 110. Other suitable configurations for optional frame/guard 140 will depend on a given application and will be apparent in light of this disclosure.

Numerous embodiments will be apparent in light of this disclosure. One example embodiment of the present invention provides a lighting device including a heat sink module and a light engine operatively coupled with the heat sink module, wherein the heat sink module comprises part of an electrical circuit which powers the light engine. In some cases, the heat sink module comprises a negative lead of the light engine. In some cases, the light engine includes a light emitting diode (LED). In some instances, the light engine is operatively coupled with the heat sink module by a quantity of electrically conductive adhesive. In some embodiments, the lighting device further includes an electrical connection operatively coupled with the light engine and configured to be operatively coupled with another heat sink module. In some such embodiments, the electrical connection includes a wire bond with a solder contact, a series conductive clip, or a card edge connector.

Another example embodiment of the present invention provides a circuit including a first lighting device including a first heat sink module and a first light engine operatively coupled with the first heat sink module, a second lighting device including a second heat sink module and a second light engine operatively coupled with the second heat sink module, an insulating connector configured to electrically isolate the first and second lighting devices from one another while physically coupling them, and an electrical connection made between the first light engine and the second heat sink module, wherein the electrical connection electrically connects the first and second lighting devices in series. In some cases, at least one of the first and second light engines includes a light emitting diode (LED). In some cases, the insulating connector includes an electrically insulating polymer, an electrically insulating composite, an electrically insulating thermoplastic, an electrically insulating epoxy, polyvinyl chloride (PVC), nylon, acrylonitrile butadiene styrene (ABS), and/or polyoxymethylene. In some instances, the electrical connection includes a wire bond with a solder contact, a series conductive clip, or a card edge connector. In some example cases, a lighting system including a plurality of the aforementioned circuit is provided, wherein said plurality is electrically connected in parallel.

Another example embodiment of the present invention provides a lighting system including a plurality of heat sink modules, a plurality of insulating connectors, wherein the plurality of insulating connectors electrically isolates the plurality of heat sink modules from one another while physically coupling the plurality of heat sink modules with one another to define, in the aggregate, a heat sink assembly, and a plurality of light engines operatively coupled with the heat sink assembly. In some cases, the heat sink assembly includes six heat sink modules, each of which is operatively coupled with a single light engine, and the system further includes ballast circuitry configured to drive the light engines with about 24 VDC. In some cases, the heat sink assembly is substantially planar. In some other cases, the heat sink assembly is substantially non-planar. In some instances, the heat sink assembly includes a plurality of heat conduits defined by virtue of how the plurality of heat sink modules is physically coupled with one another. In some such instances, at least one of the plurality of heat conduits includes a hollow tube having a cross-sectional geometry that is rectangular, square, pentagonal, hexagonal, circular, elliptical, or curved. In some other such instances, at least one of the plurality of heat conduits is of a different length than another of the plurality of heat conduits. In some cases, one or more of the plurality of light engines includes a light emitting diode (LED). In some cases, at least one of the plurality of insulating connectors is configured to electrically isolate and physically couple two or more of the plurality of heat sink modules. In some instances, a junction temperature of at least one of the plurality of light engines is controlled by dissipating thermal energy produced by the plurality of light engines from the system by a convective heat transfer process. In some cases, the system further includes a frame/guard configured to be operatively coupled with the heat sink assembly, wherein at least one of the plurality of insulating connectors is integral to the frame/guard.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A lighting device comprising:

a heat sink module including a hub and three or more vertical panel sidewalls extending radially outward from the heat sink;

an insulating connector removablely coupled to an edge located opposite the hub of one of the vertical panel sidewalls; and a light engine operatively coupled with the hub of the heat sink module;

wherein the hub and at least one of the vertical sidewalls comprises part of an electrical circuit which powers the light engine.

2. The device of claim 1, wherein the heat sink module comprises a negative lead of the light engine.

3. The device of claim 1, wherein the light engine comprises a light emitting diode (LED).

4. The device of claim 1, wherein the light engine is operatively coupled with the heat sink module by a quantity of electrically conductive adhesive.

5. The device of claim 1 further comprising an electrical connection operatively coupled with the light engine and configured to be operatively coupled with another heat sink module.

6. The device of claim 5, wherein the electrical connection comprises a wire bond with a solder contact, a series conductive clip, or a card edge connector.

7. A circuit comprising:

a first lighting device comprising:

a first heat sink module including a hub and three or more vertical panel sidewalls extending radially outward from the first heat sink; and a first light engine operatively coupled with the first heat sink module;

a second lighting device comprising:

a second heat sink module including a hub and three or more vertical panel sidewalls extending radially outward from the second heat sink; and a second light engine operatively coupled with the second heat sink module;

an insulating connector configured to electrically isolate the first and second lighting devices from one another while physically coupling them; and an electrical connection made between the first light engine and the second heat sink module through the hub and at least one of the vertical sidewalls of the first heat sink and the second heat sink, wherein the electrical connection electrically connects the first and second lighting devices in series.

8. The circuit of claim 7, wherein at least one of the first and second light engines comprises a light emitting diode (LED).

9. The circuit of claim 7, wherein the insulating connector comprises an electrically insulating polymer, an electrically insulating composite, an electrically insulating thermoplastic, an electrically insulating epoxy, polyvinyl chloride (PVC), nylon, acrylonitrile butadiene styrene (ABS), and/or polyoxymethylene.

10. The circuit of claim 7, wherein the electrical connection comprises a wire bond with a solder contact, a series conductive clip, or a card edge connector.

11. A lighting system of claim 7, wherein said the electrical connection electrically connects the first and second lighting devices in parallel.

* * * * *